US011685880B2

(12) United States Patent
Stolmaker

(10) Patent No.: US 11,685,880 B2
(45) Date of Patent: Jun. 27, 2023

(54) PEROXIDE BASED CLEANING COMPOSITIONS

(71) Applicant: Distinctive Cleaning and Maintenance Services Incorporated, Tucson, AZ (US)

(72) Inventor: Dori Stolmaker, Tucson, AZ (US)

(73) Assignee: Distinctive Cleaning and Maintenance Services Incorporated, Tucson, AZ (US)

( * ) Notice: Subject to any disclaimer, the term of this patent is extended or adjusted under 35 U.S.C. 154(b) by 666 days.

(21) Appl. No.: 16/821,702

(22) Filed: Mar. 17, 2020

(65) Prior Publication Data

US 2021/0292686 A1 Sep. 23, 2021

(51) Int. Cl.

| | |
|---|---|
| ***C11D 1/04*** | (2006.01) |
| ***C11D 3/06*** | (2006.01) |
| ***C11D 3/10*** | (2006.01) |
| ***C11D 17/00*** | (2006.01) |
| ***C11D 9/42*** | (2006.01) |
| ***C11D 9/08*** | (2006.01) |
| ***C11D 17/04*** | (2006.01) |
| ***A47L 25/00*** | (2006.01) |
| ***C11D 9/26*** | (2006.01) |
| ***C11D 1/20*** | (2006.01) |
| ***C11D 3/20*** | (2006.01) |
| ***C11D 3/39*** | (2006.01) |
| ***C11D 3/04*** | (2006.01) |

(52) U.S. Cl.

CPC ..... *C11D 9/42* (2013.01); *A47L 25/00* (2013.01); *C11D 1/04* (2013.01); *C11D 1/20* (2013.01); *C11D 3/046* (2013.01); *C11D 3/10* (2013.01); *C11D 3/2065* (2013.01); *C11D 3/3902* (2013.01); *C11D 9/08* (2013.01); *C11D 9/265* (2013.01); *C11D 17/049* (2013.01)

(58) Field of Classification Search

CPC .. C11D 1/04; C11D 1/20; C11D 3/046; C11D 3/10; C11D 3/2065; C11D 3/3902

USPC ..... 510/191, 238, 426, 477, 488, 505, 506

See application file for complete search history.

(56) References Cited

U.S. PATENT DOCUMENTS

| | | | | | |
|---|---|---|---|---|---|
| 5,849,039 | A * | 12/1998 | Sadlowski | C11D 3/3947 | 510/357 |
| 6,048,368 | A * | 4/2000 | Tcheou | C11D 11/0017 | 510/342 |
| 2008/0125344 | A1* | 5/2008 | Busch | C11D 3/3932 | 510/311 |
| 2012/0225943 | A1* | 9/2012 | Gohl | C11D 3/3945 | 510/303 |
| 2015/0080561 | A1* | 3/2015 | Torres | C09B 29/0802 | 534/766 |

FOREIGN PATENT DOCUMENTS

| | | | | |
|---|---|---|---|---|
| EP | 2963101 | A1 * | 1/2016 | C11D 1/825 |
| EP | 3284808 | A1 * | 2/2018 | C11D 1/8255 |
| GB | 2544470 | * | 5/2017 | |
| WO | WO-0026329 | A1 * | 5/2000 | A47L 13/03 |
| WO | WO-2015051864 | A1 * | 4/2015 | B08B 1/006 |

* cited by examiner

*Primary Examiner* — Gregory R Delcotto

(74) *Attorney, Agent, or Firm* — Snell & Wilmer L.L.P.

(57) ABSTRACT

The present disclosure describes a peroxide based cleaning composition comprising a peroxide; a builder; a surfactant; a peroxide stabilizer; and remainder water and optional adjuvant. In various embodiments, the cleaning composition comprises hydrogen peroxide, sodium bicarbonate, a vegetable fatty acid potassium soap, glycerin, water and essential oil. The peroxide based cleaning composition exhibits storage stability for up to about 9-months and provides cleaning efficacy on a wide variety of hard surfaces and fabrics.

9 Claims, No Drawings

PEROXIDE BASED CLEANING COMPOSITIONS

FIELD

The present disclosure generally relates to hard surface cleaners, and more particularly, to non-abrasive peroxide based cleaners for cleaning multiple surfaces in homes and institutions.

BACKGROUND

A great number of liquid ready-to-use and concentrated cleaners for dilution are available in both the retail and institutional markets. Although some cleaners may claim to be multi-surface cleaners (particularly in the retail market), the majority of these cleaners are clearly incapable of delivering on the promise of consistent cleaning performance across all surfaces. Most cleaners are actually limited in use, and end up being more specialty cleaners (e.g., for glass, stainless steel, wood, tile, porcelain, ceramic, cultured marble, or plastics, only).

Bleach cleaners are a separate category of specialized cleaners. Bleach (i.e., sodium hypochlorite) is remarkably powerful in both its capability to decolorize stains and to kill a wide spectrum of microorganisms. Use of bleach cleaners for mold and mildew in the grout of shower tile is exemplary, and the dark mold stains often disappear in just moments.

However, bleach cleaners have their own disadvantages that consumers and institutional detergent providers are well aware of. Bleach is often destructive to many surfaces (e.g., tile grout) and will ruin any fabric surfaces (e.g., rugs and carpeting) which the bleach may drip onto. Further, bleach cleaners carry serious warnings regarding eye and skin hazards, and inhalation hazards, particularly if mixed with acid cleaners, such as toilet bowl cleaners. The environmental issues centered around chloramine formation are also very problematic.

Peroxide has shown promise as a replacement for chlorine bleach in cleaners, namely both hard surface and soft surface cleaners. Peroxide has both antimicrobial properties and cleaning ability through denaturing of certain organic soils. However, peroxide is equally unstable, perhaps even more so, than chlorine bleach, and the formulation of detergents incorporating peroxide tend to be challenging.

Hence, despite the multitude of hard surface cleaners, fabric detergents and detergent additives on the market today, the need still exists for environmentally friendly cleaners capable of safely cleaning a wide variety of both hard surfaces and soft surfaces.

SUMMARY

It has now been discovered that certain combinations of anionic surfactant and stabilizer will not only preserve hydrogen peroxide based liquid cleaners from loss of peroxide (active $O_2$) activity, but the combination is unexpectedly efficient in cleaning various soils from hard surfaces and fabrics.

In various embodiments, a peroxide based cleaning composition comprises: a peroxide; a builder; a surfactant; a peroxide stabilizer, remainder water and optional adjuvant.

In various embodiments, a peroxide based cleaning composition comprises: hydrogen peroxide; a builder; an anionic surfactant; a peroxide stabilizer, remainder water, wherein the peroxide stabilizer comprising a polyol. In various embodiments, the builder comprises a carbonate. In various embodiments, the peroxide stabilizer comprises glycerin (i.e., glycerol, or propane-1,2,3-triol).

DETAILED DESCRIPTION

The following description is of various exemplary embodiments only, and is not intended to limit the scope, applicability or configuration of the present disclosure in any way. While these exemplary embodiments are described in enough detail to enable those skilled in the art to practice the invention, other embodiments may be realized, and logical, chemical, and mechanical changes may be made without departing from the spirit and scope of the inventions. Thus, the detailed description is presented for purposes of illustration only and not of limitation. For example, unless otherwise noted, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

As described in more detail herein, various embodiments of the present disclosure generally comprise a peroxide based cleaning composition useful for the cleaning of numerous soils from hard and soft surfaces. In various embodiments, a peroxide based cleaning composition comprises: hydrogen peroxide; a builder; a surfactant; a peroxide stabilizer, remainder water and optional adjuvant.

Definitions

As used herein, the term "cleaning composition" takes on its ordinary meaning of a mixture of ingredients in an aqueous carrier for the purposes of removing soils on various hard and soft surfaces in homes and institutions. Cleaning compositions herein may be concentrates to be diluted by a user before use, or they may be ready to use compositions, meaning they are at the ideal concentration for use without further dilution. Ready to use compositions herein may be applied to surfaces in any manner, including spraying, pouring or by use of a cloth or sponge. Cleaning compositions herein may be rinsed from surfaces, or wiped without rinsing. Soils that may be removed from hard and soft surfaces using the cleaning compositions herein include any protein, carbohydrate, fat or oil, including natural (e.g., food) and manmade (e.g., motor oil, lube grease).

As used herein, the term "adjuvant" refers to minor ingredients that may be added to a cleaning composition for purposes such as odor and physical appearance (color, viscosity, etc.), or to control water hardness and such. Thus, adjuvants for use herein include, but are not limited to, fragrances, pigments, and other dyes, thickeners and chelants. Care is made not to include preservatives within adjuvants, so as to place hydrogen peroxide stabilizers (preservatives in a sense) in a separate ingredient category. In general, the adjuvants may be considered as optional ingredients in a peroxide based cleaning composition of the present disclosure. In various embodiments, peroxide cleaning compositions are free of colors and fragrances. In various embodiments, peroxide cleaning compositions are free of color, but have a fragrance capable of presenting a better cleaning experience, or that might be residual on surfaces for an extended period of time.

As used herein, the term "composition" takes on the ordinary meaning in formulation chemistry as a combination of ingredients. In various embodiments, a composition is designed to adopt a particular physical form, such as a pourable or sprayable liquid, or a thick paste. Typically, a composition is made homogeneous by mixing or blending, although not all liquid compositions are colorless and transparent and not all powder compositions are white and perfectly granular. Compositions comprising an emulsion, dispersion or suspension may be homogeneous because the droplets or particles are evenly spread in a carrier such as water. So, for example, a composition herein may be in the form of a thin liquid (having a viscosity at or near that of water), or a slightly viscous liquid (having a liquid of viscosity greater than water), or as a thick paste. In various embodiments, an optional thickener may be added to change the appearance of an otherwise thin liquid, such as to give it marketable presence. Ingredients for a composition herein are generally shown "as added," meaning there is a possibility for one or more chemical reactions between ingredients once the ingredients are mixed together into water. One skilled in the art of formulation chemistry can recognize whether ingredients might react in a mixture. These reactions can include neutralization (e.g., between acid and alkali ingredients, hydrolysis, and so forth. In various embodiments, certain ingredients used in a cleaning composition may entrain a small amount of water into the composition. Effort is made to separate out the water content, if not trivial, in the formula details, although there may be occasion when a commercially sourced raw material has an unknown or incalculable amount of water that will come into the cleaning composition. In various embodiments, ingredients in a composition are listed in "weight percent," (i.e., "%"), based on the total weight of the composition. For example, 100 kilograms of a cleaning composition comprising 40 kilograms A and 60 kilograms B may be recited as "40 wt. % A and 60 wt. % B, based on the total weight of the composition," which necessarily totals to "100 wt. %." The actual weight amounts, (e.g., grams or kilograms) generally refers to amounts added for a particular batch size, (e.g., a batch size of liquid cleaning composition to fill quart or gallon containers, drums, or tanks).

As used herein, the term "polyol" refers to any organic substance having at least three hydroxyl-groups present on the molecule, including small molecular weight substances and high polymers. Typical examples include propane-1,2,3-triol (i.e., glycerol, or glycerin), hexan-1,3,5-triol, 1,2,4-benzenetriol, ethane-1,1,2-triol, 5-hexene-1,2,3-triol, butane-1,2,3-triol, p-menthane-1,2,3-triol, (poly)vinyl alcohol, and so forth.

Peroxide

In various embodiments, the compositions in accordance to the present disclosure comprise peroxide. In various embodiments, the source of peroxide is selected from the group consisting of organic peroxides percarbonate salts, persulfate salts, perborate salts, peroxybenzoic acid, peracetic acid, and hydrogen peroxide. Some of these substances may be best viewed as peroxide precursors, or peroxide generators, in that they react in water to produce inorganic or carboxylate salts and hydrogen peroxide. In preferred embodiments, the peroxide based cleaning compositions herein comprise hydrogen peroxide, which is more conveniently added to the composition as aqueous hydrogen peroxide solution.

Commercially available hydrogen peroxide (aqueous $H_2O_2$) is available in a number of strengths, typically 3, 6, 20, 30, 31, 32, 34, 35, 50, 70 and 98 wt. % aqueous solutions. The lower end strengths are typical for topical, household use, whereas the more concentrated are hazardous to handle and are found in industrial use. Any strength hydrogen peroxide finds use herein, although choices may be made depending on the active $O_2$ strength desired in the final peroxide based cleaning compositions and how much further diluent (water) will be added to the composition. In various embodiments, 3 wt. % hydrogen peroxide is used in the compositions herein, negating the need for any further dilution of the composition with added water. Aqueous hydrogen peroxide is available from a number of suppliers, and in particular Hawkins, Inc., Roseville, Minn., USA.

Commercial aqueous hydrogen peroxide solutions tend to be acidic as shipped, partly due to the mode of production and also the addition by manufactures of mineral acids for stability. In general, higher pH (e.g., alkaline hydrogen peroxide) tends to be more effective at beaching and cleaning, whereas acidic hydrogen peroxide tends to be more effective as an antimicrobial. Hence, acidic hydrogen peroxide, most particularly 3 wt. % "drugstore" hydrogen peroxide is used as a topical antiseptic. In various embodiments herein, the peroxide based cleaning compositions utilize alkaline hydrogen peroxide, achieved in the final cleaning composition by adding alkali builder to otherwise acidic, commercially sourced hydrogen peroxide, in order to reach a final pH of >7 for the final cleaning composition. The alkaline pH of the compositions herein heighten the bleaching and cleaning efficacy of the peroxide based cleaning compositions.

In various embodiments, peroxide based cleaning compositions in accordance with the present disclosure comprise from about 0.1 to about 1.0 wt. % hydrogen peroxide, based on the total weight of the composition. Correspondingly, peroxide based cleaning compositions in accordance with the present disclosure comprise from about 3.0 to about 33 wt. % of 3 wt. % commercial hydrogen peroxide, based on the total weight of the composition.

Surfactants

Peroxide based cleaning compositions herein include one or more anionic surfactants to assist with cleaning particulate soils and also to degrease fatty oils from kitchens and baths. Preferred are the fatty soaps, and particularly vegetable oil soaps that can optionally be obtained as certified organic and vegan.

Fatty soaps in the peroxide based cleaning composition of the present disclosure are particularly suitable to aid fat and oil removal from kitchen sinks and appliances, and shower/tub/enclosure surfaces. As used here, "fatty soap" means the salts of fatty acids. For example, the fatty soaps that may be used here have general formula R—$CO_2$M, wherein R represents a linear or branched alkyl or alkenyl group having between about 8 and 24 carbons and M represents an alkali metal such as sodium or potassium or ammonium or alkyl- or dialkyl- or trialkyl-ammonium or alkanol-ammonium cation. The fatty acid soaps for use herein may be comprised of higher fatty acid soaps. That fatty acids that may be the feed stock to the fatty soaps may be obtained from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, hemp oil, jojoba oil; peanut oil, corn oil, sesame oil, rice bran oil, cottonseed oil, babassu oil, soybean oil, castor oil, and mixtures thereof. Fatty acids can be synthetically prepared, for example, by the oxidation of petroleum, or by hydrogenation of carbon monoxide by the Fischer-Tropsch process. The fatty acids of particular use in the present compositions are linear or branched and containing from about 8 to about 24 carbon atoms, preferably from about 10 to about 20 carbon atoms and most preferably from about 14 to about 18 carbon atoms. Preferred fatty acids for use in the present compositions are coconut, palm kernel, hemp oil, and/or jojoba oil fatty acids, and their preferred salts (soaps) therefrom are alkali metal salts, such as sodium or potassium or mixtures thereof. Other useful soaps are ammonium and alkanolammonium salts of fatty acids. The fatty acids that may be included in the present compositions will preferably be chosen to have desirable hard surface cleaning efficacy and foam regulation, and may be certified organic vegetable soaps.

Of use herein is a brand of fatty acid soap called Dr. Bronner's Pure Castile Soap®, which is an unscented Castile soap comprising organic coconut oil, potassium hydroxide, organic palm kernel oil, organic olive oil, organic hemp oil, organic jojoba oils, citric acid and tocopherol. This liquid soap is used as a raw material for the peroxide based compositions herein.

In various embodiments, peroxide based cleaning compositions comprise from about 1.0 to about 10.0 wt. % fatty acid soap, based on the total weight of the composition, with the fatty acid being animal or vegetable fats. In various embodiments, the fatty acid soap comprises a mixture of the potassium salts of coconut, palm kernel, olive oil, hemp oil, and jojoba oil fatty acids, with an undisclosed amount of glycerin resulting from saponification of these oils. In various embodiments, the fatty acid soap used is Dr. Bronner's Pure Castile Soap®. Since in various embodiments, glycerin is added to the peroxide based compositions of the present disclosure, the amount of glycerin entrained into the composition from a fatty acid soap such as Dr. Bronner's Pure Castile Soap® is ignored.

Other suitable anionic surfactants include the sulfonate and sulfate types. Preferred surfactants of the sulfonate type include $C_{9-13}$ alkyl benzenesulfonates, olefin sulfonates, hydroxy alkane sulfonates and disulfonates, as are obtained, for example, from $C_{12-18}$ monoolefins having a terminal or internal double bond by sulfonating with gaseous sulfur trioxide followed by alkaline or acidic hydrolysis of the sulfonation products. Anionic surfactants that may find use in the compositions of the present disclosure include the alkyl benzene sulfonate salts. Suitable alkyl benzene sulfonates include the sodium, potassium, ammonium, lower alkyl ammonium and lower alkanol ammonium salts of straight or branched-chain alkyl benzene sulfonic acids. Alkyl benzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids, functioning as precursors to the alkyl benzene sulfonates useful for compositions herein, are those in which the alkyl chain is linear and averages about 8 to 16 carbon atoms ($C_8$-$C_{16}$) in length. Examples of commercially available alkyl benzene sulfonic acids useful in the present invention include Calsoft® LAS-99, Calsoft® LPS-99 or Calsoft® TSA-99 marketed by Pilot Chemical. Also, of use in the present compositions is sodium dodecylbenzene sulfonate, available commercially as the sodium salt of the sulfonic acid, for example Calsoft® F-90, Calsoft® P-85, Calsoft® L-60, Calsoft® L-50, or Calsoft® L-40. Also usable are the ammonium salts, lower alkyl ammonium salts and the lower alkanol ammonium salts of linear alkyl benzene sulfonic acid, such as triethanol ammonium linear alkyl benzene sulfonate including Calsoft® T-60 sold by Pilot Chemical.

Also, with respect to the anionic surfactants useful in the peroxide based compositions herein, the alkyl ether sulfates, also known as alcohol ether sulfates, are useful. Alcohol ether sulfates are the sulfuric monoesters of the straight chain or branched alcohol ethoxylates and have the general formula $R—(CH_2CH_2O)_x—SO_3M$, where $R—(CH_2CH_2O)_x—$ preferably comprises $C_7$-$C_{21}$ alcohol ethoxylated with from about 0.5 to about 9 mol of ethylene oxide (x=0.5 to 9 EO), such as $C_{12}$-$C_{18}$ alcohols containing from 0.5 to 9 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 9 ethylene oxide moieties and most preferred are the $C_{12}$-$C_{15}$ alcohol ether sulfates with ethoxylation from about 4 to about 9 ethylene oxide moieties, with 7 ethylene oxide moieties being most preferred. It is understood that when referring to alkyl ether sulfates, these substances are already salts (hence designated "sulfonate"), and most preferred and most readily available are the sodium alkyl ether sulfates (also referred to as NaAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, however most of these have fairly low EO content (e.g., average 3 or 4-EO). Alternatively, the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. For example, sodium lauryl ether sulfate ("sodium laureth sulfate", having about 3 ethylene oxide moieties) is very readily available commercially and quite common in shampoos and detergents, however, this is not the preferred level of ethoxylation for use in the present invention for hard surface cleaning. Therefore, it may be more practical to sulfonate a commercially available nonionic surfactant such as Neodol® 25-7 Primary Alcohol Ethoxylate (a $C_{12}$-$C_{15}$/7EO nonionic from Shell) to obtain the $C_{12}$-$C_{15}$/7EO alkyl ether sulfate that may have been difficult to source commercially. The preferred level of $C_{12}$-$C_{18}$/0.5-9EO alkyl ether sulfate in the present invention is from about 1% to about 50%. Most preferred is from about 3% to about 40%.

Other anionic surfactants that may be included in the peroxide based compositions herein include the alkyl sulfates, also known as alcohol sulfates. These surfactants have the general formula $R—O—SO_3Na$ where R is from about 10 to 18 carbon atoms, and these materials may also be denoted as sulfuric monoesters of $C_{10}$-$C_{18}$ alcohols, examples being sodium decyl sulfate, sodium palmityl alkyl sulfate, sodium myristyl alkyl sulfate, sodium dodecyl sulfate, sodium tallow alkyl sulfate, sodium coconut alkyl sulfate, and mixtures of these surfactants, or of $C_{10}$-$C_{20}$ oxo alcohols, and those monoesters of secondary alcohols of this chain length. Also useful are the alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, $C_{12}$-$C_{16}$-alkyl sulfates, $C_{12}$-$C_{15}$-alkyl sulfates, and also $C_{14}$-$C_{15}$ alkyl sulfates, are all preferred. For example, sodium lauryl sulfate from the Stepan Company sold under the trade name of Polystep® can be used.

Additional anionic surfactants that may find use in the peroxide based compositions of the present disclosure include the alpha-sulfonated alkyl esters of $C_{12}$-$C_{16}$ fatty acids. The alpha-sulfonated alkyl esters may be pure alkyl ester or a blend of (1) a mono-salt of an alpha-sulfonated alkyl ester of a fatty acid having from 8-20 carbon atoms where the alkyl portion forming the ester is straight or branched chain alkyl of 1-6 carbon atoms and (2) a di-salt of an alpha-sulfonated fatty acid, the ratio of mono-salt to di-salt being at least about 2:1. The alpha-sulfonated alkyl esters useful herein are typically prepared by sulfonating an alkyl ester of a fatty acid with a sulfonating agent such as $SO_3$. When prepared in this manner, the alpha-sulfonated alkyl esters normally contain a minor amount, (typically less than 33% by weight), of the di-salt of the alpha-sulfonated fatty acid which results from saponification of the ester. Preferred alpha-sulfonated alkyl esters contain less than about 10% by weight of the di-salt of the corresponding alpha-sulfonated fatty acid.

The alpha-sulfonated alkyl esters, i.e., alkyl ester sulfonate surfactants, include linear esters of $C_6$-$C_{22}$ carboxylic acids that are sulfonated with gaseous $SO_3$. Suitable starting materials preferably include natural fatty substances as derived from tallow, palm oil, etc., rather than from petroleum sources. The preferred alkyl ester sulfonate surfactants, especially for a peroxide based composition herein, comprise alkyl ester sulfonate surfactants of the structural formula $R^3$—$CH(SO_3M)$-$CO_2R^4$, wherein $R^3$ is a $C_8$-$C_{20}$ hydrocarbon chain preferably naturally derived, $R^4$ is a straight or branched chain $C_1$-$C_6$ alkyl group and M is a cation which forms a water soluble salt with the alkyl ester sulfonate, including sodium, potassium, magnesium, and ammonium cations. Preferably. $R^3$ is $C_{10}$-$C_{16}$ fatty alkyl, and R is methyl or ethyl. Most preferred are alpha-sulfonated methyl or ethyl esters of a distribution of fatty acids having an average of from 12 to 16 carbon atoms. For example, the alpha-sulfonated esters Alpha-Step® BBS-45, Alpha-Step® MC-48, and Alpha-Step® PC-48, all available from the Stepan Co. of Northfield, Ill., may find use in the present invention.

Other than the preferred anionic surfactant, and most preferably, a vegetable fatty acid soap, peroxide based cleaning compositions of the present disclosure may optionally include, in addition to the anionic surfactant, a nonionic surfactant.

Exemplary nonionic surfactants include, but are not limited to, aliphatic primary or secondary linear or branched chain fatty alcohols or phenols, fatty acid esters, mono-, di-, and tri-fatty acid glycerides, alkyl alkoxylates, alkyl phenol alkoxylates, block alkylene oxide condensates of alkyl phenols, alkylene oxide condensates of alkanols, ethylene oxide/propylene oxide (EO/PO) block copolymers, amine oxides, phosphine oxides, mono- or di-alkyl alkanolamides, alkyl polysaccharides, sorbitan fatty acid esters, polyoxyethylene sorbitan fatty acid esters, polyoxyethylene sorbitol esters, polyoxyethylene esters, polyoxyethylene alcohols, mono- and diethanolamides, polyglycosides, polyglucosides, diglucoside, alkyl polyglucoside, polysorbates, alkoxylated fatty alcohols, alkoxylated fatty acid glycerides, and mixtures thereof.

Builders

In various embodiments, the peroxide based compositions of the present disclosure include at least one builder. Such builders may include but are not limited to carbonates, bicarbonates, silicates, borates, zeolites, phosphates, citrates, alkali metal hydroxides. In specific embodiments, the builder comprises one or more alkaline materials, although the composition may comprise a >7 pH buffer system based on a combination of an alkaline material and an acidifying material, but with the buffer configured such that the final composition is buffered to an alkaline pH (>7). There are known pH>7 buffers in the chemistry literature that can be selected. Buffers may be mixed buffers, meaning that the alkaline agent is not necessarily the conjugate base of the acidifying agent.

In select embodiments, only an alkaline material is included in the composition as the detergent builder. The alkaline ingredient is added in sufficient quantity to not only neutralize any acid components entrained in the composition from the commercial hydrogen peroxide used, but also to provide additional cleaning through saponifying alkalinity. In various embodiments, one or more builders are present at from about 70 to about 85 wt. %, based on the total weight of the composition.

Exemplary builders include any organic amines, $NH_3$, alkali metal or alkaline earth hydroxide, any conjugate bases of any organic acids (e.g. R—$COO^-$), and any of the salts of carbonic acid, phosphoric acid, nitric acid and sulfuric acid, and any mixtures thereof. For example, builders for use in various embodiments of the composition in accordance to the present disclosure may include, but are not limited to, NaOH, KOH, $NH_3$, sodium acetate, sodium succinate, disodium succinate, monosodium citrate, disodium citrate, trisodium citrate, $NaH_2PO_4$, $Na_2HPO_4$, $Na_3PO_4$, $KH_2PO_4$, $K_2HPO_4$, $K_3PO_4$, $NaHSO_4$, $Na_2SO_4$, $KHSO_4$, $K_2SO_4$, $NaHCO_3$, $Na_2CO_3$, $KHCO_3$, $K_2CO_3$, $NaH_3P_2O_7$, $Na_2H_2P_2O_7$, $Na_3HP_2O_7$, $Na_4P_2O_7$, $KH_3P_2O_7$, $K_2H_2P_2O_7$, $K_3HP_2O_7$, $K_4P_2O_7$, and mixtures thereof. Any of these chemical species may exist as various hydrates when purchased as raw materials for use in the present compositions.

Further useful builders include the silicates. optional silicate builder may comprise a combination of liquid silicate and anhydrous silicate. The preferred silicate is an alkali metal silicate salt (the alkali metal salts of silicic acid) with the sodium and potassium silicate salts being the most preferred. The alkali metal silicates that are useful may be in a variety of forms that can be described by the general formula $M_2O$:$SiO_2$, wherein M represents the alkali metal and in which the ratio of the two oxides varies Most useful alkali metal silicates will have a $SiO_2/M_2O$ weight ratio of from about 1.6 to about 4. Preferred silicates include the Sodium Silicate Solutions from PQ Corporation, such as A®1647 Sodium Silicate Solution, a 46.8% active solution of sodium silicate having a $SiO_2/Na_2O$ ratio of about 1.6 to about 1.8.1. Also of use in the compositions of the present disclosure are the potassium silicates, such as the Kasil® products from PQ Corporation. For example, Kasil®1 Potassium Silicate Solution is a 29.1% solution of potassium silicate having a $SiO_2/K_2O$ ratio of about 2.5. Also, of use is sodium metasilicate and sodium silicate, such as the hydrous sodium silicate Britesil® C24 available from PQ Corporation.

In specific embodiments, the peroxide based cleaning composition comprises only a single builder, namely sodium bicarbonate ($NaHCO_3$). In various embodiments, the sodium bicarbonate is present from about 70 wt. % to about 85 wt. %, based on the total weight of the composition.

For buffered compositions, an acidifying agent may also be used, in addition to the alkaline builder. Exemplary acidifying agents for use in the present compositions include, but are not limited to, organic acids of any molecular weight and mineral acids (inorganic acids), and mixtures thereof. Organic acids may include mono-carboxylic acids, di-carboxylic acids, or tri-carboxylic acids, and may be saturated or may have any degree of unsaturation. For example, organic acids for use in various embodiments of the composition in accordance to the present disclosure may include, but are not limited to, formic acid, carbonic acid, acetic acid, lactic acid, oxalic acid, propionic acid, valeric acid, enanthic acid, pelargonic acid, butyric acid, lauric acid, docosahexaenoic acid, eicosapentaenoic acid, pyruvic acid, acetoacetic acid, benzoic acid, salicylic acid, aldaric acid, fumaric acid, glutaconic acid, traumatic acid, muconic acid, malonic acid, malic acid, succinic acid, glutaric acid, adipic acid, pimelic acid, suberic acid, azelaic acid, abietic acid, pimaric acid, sebacic acid, phthalic acid, isophthalic acid, terephthalic acid, maleic acid, citric acid, and combinations thereof. For example, mineral acids for use in various embodiments of the composition in accordance to the present disclosure may include, but are not limited to hydrochloric acid, phosphoric acid, sulfuric acid, nitric acid, and combinations thereof.

Peroxide Stabilizer

Typical hydrogen peroxide stabilizers are based on chelants or sequestrants. Known stabilizers include colloidal stannate, sodium pyrophosphate, various organophosphonates (e.g., products sold by Monsanto under the trade name Dequest®), nitrate/phosphoric acid, and colloidal silicate. In various embodiments, a peroxide stabilizer is incorporated at from about 1 to about 10 wt. %, based on the total weight of the composition.

However, it has now been discovered that a polyol, and particularly glycerol, stabilizes hydrogen peroxide in the present compositions. Heretofore, it appears the use of glycerol for hydrogen peroxide stabilization has not been previously described. In various embodiments, peroxide based compositions of the present disclosure comprise from about 1 to about 10 wt. % glycerin, based on the total weight of the composition. Glycerin at these levels is expected to also act as a solvent in the cleaning composition, helping to dissolve greases.

Water

In various embodiments, peroxide based compositions comprise water as the carrier, such that the product is a liquid, although the viscosity target may be such that the composition comprises a thick paste. In certain embodiments, all of the water desired in the composition is entrained in the composition by use of a low percent hydrogen peroxide solution as a raw material, e.g., only 3% $H_2O_2$. If stronger solutions of hydrogen peroxide are used, water can be added at quantity sufficient (q.s.) to complete the formulation. In various embodiments, the water comprises distilled water or softened water. In various embodiments, the total amount of water plus any optional adjuvant is from about 10 to about 15 wt. % based on the total weight of the composition.

Optional Adjuvants

As mentioned, peroxide based cleaning compositions of the present disclosure may further comprise one or more optional adjuvants, e.g., fragrances, pigments and dyes, chelants, and so forth as desired.

1. Fragrances:

The peroxide based cleaning compositions preferably include a fragrance. It is desirable to add a fragrance that can be perceived while cleaning, and that may remain substantive on surfaces. The latter may require; the use of substantive fragrances that have an increased longevity due to the nature of the fragrance components themselves (i.e. fragrance ingredients having lower volatility); the use of a fairly large amount of fragrance; and/or, the use of encapsulated fragrance(s), or combinations of these options.

Exemplary fragrances for use in the compositions of the present disclosure include, but are not limited to, anethole, menthol, eucalyptol, borneol, borneol acetate, camphor, 1,8-cineole, cinnamaldehyde, clove oil, benzaldehyde, citral, thujone, eugenol, limonene, geraniol, citronellol, citronellal, pinene, linalool, thymol, carvone, caryphyllene, linalyl acetate, methyl salicylate, 3,3,5-trimethylcyclohexanol, methoxycyclohexanol, benzyl alcohol, anise alcohol, cinnamyl alcohol, β-phenyl ethyl alcohol (2-phenylethanol), cis-3-hexenol, musk xylol, isoeugenol, methyl eugenol, α-amylcinnamic aldehyde, anisaldehyde, n-butyl aldehyde, cumin aldehyde, cyclamen aldehyde, decanal, isobutyl aldehyde, hexyl aldehyde, heptyl aldehyde, n-nonyl aldehyde, nonadienol, hydroxycitronellal, benzaldehyde, methyl nonyl acetaldehyde, dodecanol, α-hexylcinnamic aldehyde, undecenal, heliotropin, vanillin, ethyl vanillin, methyl amyl ketone, methyl ρ-naphthyl ketone, methyl nonyl ketone, musk ketone, diacetyl, acetyl propionyl, acetyl butyryl, acetophenone, p-methyl acetophenone, ionone, methyl ionone, amyl butyrolactone, diphenyl oxide, methyl phenyl glycidate, γ-nonyl lactone, coumarin, cineole, ethyl methyl phenyl glycydate, methyl formate, isopropyl formate, linalyl formate, ethyl acetate, octyl acetate, methyl acetate, benzyl acetate, butyl propionate, isoamyl acetate, isopropyl isobutyrate, geranyl isovalerate, allyl capronate, butyl heptylate, octyl caprylate octyl, methyl heptynecarboxylate, methine octynecarboxylate, isoacyl caprylate, methyl laurate, ethyl myristate, methyl myristate, ethyl benzoate, benzyl benzoate, methylcarbinylphenyl acetate, isobutyl phenylacetate, methyl cinnamate, cinnamyl cinnamate, ethyl anisate, methyl anthranilate, ethyl pyruvate, ethyl α-butyl butylate, benzyl propionate, butyl acetate, butyl butyrate, p-tert-butylcyclohexyl acetate, cedryl acetate, citronellyl acetate, citronellyl formate, p-cresyl acetate, ethyl butyrate, ethyl caproate, ethyl cinnamate, ethyl phenylacetate, ethylene brassylate, geranyl acetate, geranyl formate, isoamyl salicylate, isoamyl isovalerate, isobornyl acetate, linalyl acetate, methyl anthranilate, methyl dihydrojasmonate, β-phenylethyl acetate, trichloromethylphenyl carbinyl acetate, terpinyl acetate, vetiveryl acetate, and mixtures thereof Encapsulated fragrances are well known in the art, and are used in the peroxide based cleaning composition to give a longer-lasting fragrance impression on surfaces. Encapsulation of fragrance has been described in many prior art references, including but not limited to; U.S. Pat. No. 7,338,928 to Lau et al.; U.S. Pat. No. 7,294,612 to Popplewell et al.; U.S. Pat. No. 7,196,049 to Brain et al.; U.S. Pat. No. 7,125,835 to Bennett et al.; U.S. Pat. No. 7,122,512 to Brain et al.; U.S. Pat. No. 7,119,057 to Popplewell et al.; U.S. Pat. No. 6,147,046 to Shefer et al.; U.S. Pat. No. 6,142,398 to Shefer et al.; U.S. Pat. No. 4,446,032 to Munteanu et al. and, U.S. Pat. No. 4,464,271 to Munteanu, each of which is incorporated herein by reference. Fragrance encapsulation has been optimized and is available through various suppliers, most notably LIPO Technologies, Inc., Vandalia, Ohio, and Alco Chemical, Chattanooga, Tenn., (e.g., using Alcocap® natural polymers for encapsulation). Encapsulation is described thoroughly in "Microencapsulation: Methods and Industrial Applications", Benita (Ed.), Marcel Dekker, Inc., New York, 1996. Fragrance microcapsules obtained from LIPO, Alco, or the fragrance houses, or as obtained through any of these published methods may be incorporated in the peroxide based cleaning compositions herein at from about 0.01% to about 5% by weight in the liquid composition, which is then applied to the substrate and dried to give slow-release fragrance perception from the article. In the dried and finished cleaning article of the present invention, it is preferred to use encapsulated fragrance (microcapsules) at from about 0.1 to about 1.0 wt % based on the total weight of the composition.

In select embodiments, a fragrance selected from the group consisting of lemon, orange, pine, floral, mint, clove, eucalyptus, cinnamon, and mixtures thereof is incorporated in the peroxide based cleaner at from about 0.01 to about 5 wt. %, based on the total weight of the composition. At this level, some perceivable fragrance is likely to remain after cleaning a hard surface or fabric. In the case of essential oils, any ethanol or other extraction solvent that might be present in the essential oil is ignored in the final peroxide based cleaning composition.

2. Pigments and Dyes:

The peroxide based cleaning composition may also contain a colorant or dyes. Dyes are optional ingredients within the compositions of the present disclosure since color may not be preferred for marketing reasons. Dyes may comprise pigments, or other colorants, chosen so that they are compatible with the other ingredients in the detergent composition, compatible with the manufacturing process, and not staining to grout, worn vitreous, and other porous surfaces or to fabrics.

Non-limiting examples of dyes for use in the peroxide based cleaning compositions of the present disclosure include Liquitint® Green FS, C.I. Pigment Green #17, C.I. Reactive Green #12, F D & C Green #3, C.I. Acid Blue #80, C.I. Acid Yellow #17, Liquitint® Red MX, F D & C Yellow #5, Liquitint® Violet LS, Fast Turquoise GLL, Liquitint® Blue MC, Liquitint® Blue HP, titanium dioxide, yellow iron oxide, red iron oxide and black iron oxide, the organic pigments such as D&C Red 36, Red 30 and Red 34, the solvent soluble colors D&C Yellow 11, Yellow 7, Red 27, Red 21, Red 17, Green 6, and Violet 2, and the water soluble colors D&C Green 8, Yellow 10, Yellow 8, Orange 4, Red 22, Red 28, Red 33, Green 5, quinoline yellow, FD&C Yellow 5, Yellow 6, Red 4, Red 40, Red 3, Green 3, Blue 1, Blue 2, and ponceau 4R, carmoisine, amaranth, patent blue V and black PN, and a number of "organic lakes," and mixtures thereof. One or more dyes can be included in the peroxide based cleaning compositions at from about 0.0001 to about 0.1 wt. %, based on the total weight of the composition.

3. Thickener:

Peroxide based cleaning compositions in accordance with various embodiments of the present disclosure may further comprise one or more thickeners. Such materials may be natural, synthetic or semisynthetic, and may be organic/polymeric or inorganic substances, or mixtures thereof. Polymers may include homo-polymers, random co-polymers and block co-polymers. Polymers may also include proteins such as albumin, or other natural polymers such as chitin or xanthan. Inorganic thickening agents may include, but are not limited to, such materials as clays and silica gel. A thickener used herein may be nonionic, anionic, cationic, or amphoteric, or an inorganic mineral or salt. A thickener may be incorporated as its salt (partial or full) having any counterion(s), (e.g., $Na^+$, $K^+$, $Cl^-$, etc.) as appropriate for particular ionizable groups therein.

Thickeners may be used to provide any one, or combination of, bulk, viscosity or rheology characteristics in the compositions. In various embodiments, one or more thickeners may be added to impart certain rheology characteristics to the present compositions, such as a desired shear, yield, deformation, plasticity, elasticity, viscoelasticity, pseudo-plasticity, or the like.

Thickening agents include, but are not limited to, carboxymethyl cellulose, carboxyethyl cellulose, hydroxyethyl cellulose, hydrophobically modified hydroxyethyl cellulose, hydroxypropyl cellulose, hydroxypropyl methyl cellulose, methyl cellulose, ethyl cellulose, microcrystalline cellulose, nitrocellulose and other cellulosic thickeners, polyvinyl alcohol, polyvinylpyrrolidone, polyvinylmethacrylate, polyacrylates, acrylate co-polymers such as acrylic acid/vinyl pyrrolidone cross-polymer, carboxyvinyl polymers, polyvinylacetate, polyvinyl co-polymers, polyurethanes, various starches, modified starches, dextrin, xanthan and other gums, agar, alginic acid and alginates, pectin, gelatin and other hydrocolloids, gelling agents, casein, albumin, chitin, collagen, silica gel, fumed silica, magnesium aluminum silicates, clay, bentonite, hectorite, and combinations thereof.

One or more thickeners may be incorporated in the compositions of the present disclosure at levels of about 0.001 to about 10 wt. %, based on the total weight of the composition.

4. Other Optional Ingredients:

Optional ingredients that may be included in the detergent composition within the substrate include but are not limited to other peroxide agents (percarbonates, perborates, and the like), enzymes (such as proteases, amylases, lipases, and cellulases and the like), nonaqueous solvents (methanol, isopropanol, ethanol, various glycol ethers, glycols, and the like), cationic surfactants, surface modifying polymers (for hydrophilic modification of the hard surfaces for future easier cleaning), emulsifiers, catalysts, enzyme stabilizers, inorganic or organic absorbents, clays, active salts, abrasives, and anti-foaming agents (silicones, and the like).

EXAMPLES

TABLE 1 sets forth both a generalized composition encompassing various embodiments and preferred embodiment with details as to the specific ingredients.

| | Compositions | |
|---|---|---|
| Ingredient (wt. %) | General Embodiments | Specific Embodiment |
| Peroxide (actives) | 0.1 to 1 | 0.4[1] |
| Builder | 70 to 85 | 80.3[2] |
| Surfactant | 1 to 10 | 3.3[3] |
| Peroxide stabilizer | 1 to 10 | 3.8[4] |
| Water and adjuvant | 10 to 15 | 12.2[5] |
| Total | 100.00 wt. % | 100.00 wt. % |

TABLE 1 notes: (1) hydrogen peroxide (from adding 12 wt. % of 3% active $H_2O_2$); (2) sodium bicarbonate; (3) vegetable fatty acid soap, preferably Dr. Bronner's Pure Castile Soap® liquid, the composition of which is described herein above; (4) pure vegetable glycerin; and (5) 0.4 wt. % of clove, eucalyptus or cinnamon essential oil, with the remaining 11.8 wt. % water (from the 3% active $H_2O_2$ that contains 97 wt. % water). The appearance of the general embodiments may range from clear liquids, to clear viscous liquids, to clear thick pastes. The appearance of the specific embodiment in TABLE 1 is a thick clear paste. The product is uniquely used by directly applying the product to the surface to be cleaned and then rinsing the product off the surface using a cloth. The product may be scooped out from the container in which it is stored. So unlike a typical "ready-to-use" cleaner that might be in the form of a thin, sprayable liquid, this particular composition is a clear thick paste that is ready-to-use much like a cleanser or polish.

In the specific embodiment in TABLE 1, a simple recipe can be followed to produce the composition as stated. To 1-cup retail hydrogen peroxide (3%) is added 3-cups sodium bicarbonate (baking soda). After mixing, % cup vegetable fatty acid soap is added (preferably Dr. Bronner's Pure Castile Soap®) followed by % cup pure vegetable glycerin. To the mixture is added 15-drops of an essential oil selected from the group consisting of clove, eucalyptus, and cinnamon oils. After mixing, the peroxide based cleaning composition may be stored in a closed container, sealed except for venting from any 02 outgassing. This example composition remains stable up to about 9-months without discoloration or change in cleaning efficacy. Most of the ingredients can be sourced as certified organic, and some even vegan.

Packaging—A Cleaning Kit

The peroxide based cleaning compositions of the present disclosure can be packaged into unique packaging that provides both a vent for any liberated 02 and a cleaning cloth in ready position for spreading the cleaning composition on a surface and assisting in the rinsing of product from the surface. In various embodiments, the cleaning composition is packaged in a glass jar with a large screw cap lid. In various aspects, the jar may comprise a 32 ounce or 16 ounce Mason jar. The cleaning cloth is laid over the opening of the filled jar and then the screw cap is secured thereon to provide a cleaning kit. Although it may appear the jar is airtight, the cloth that necessarily runs through the screw threads between jar and lid provide a vent for any escaping $O_2$. When the cleaning kit is opened, the product, e.g., in the form of a thick paste, may be scooped from the container and applied to the surface to be cleaned. The cloth, made readily available being screwed down to the container, may be used to spread the thick product on the surface and to assist in rinsing the surface when the cloth is put into rinse water.

Cleaning Cloth

The above mentioned cloth, which as mentioned acts also to vent the storage jar, may comprise a nonwoven. In various embodiments, this swatch of nonwoven may be about 8×8 inches (20×20 cm). In various embodiments, there is one cloth per container of cleaning composition. The measurements of the cloth can change depending on the size of the opening of the container and the practical size necessary for a cleaning cloth.

In various embodiments, a variety of materials may be used to form the cleaning cloth. For example, the substrate may be natural based paper, cotton or cellulose materials (e.g., pulp or viscose rayon), entirely synthetic material (e.g., melt-blown, spun-laid, air-laid or carded polypropylene, polyester, or similar synthetic polymer fibers) or combinations of natural and synthetic materials (such as pulp wet-laid onto a nonwoven web, or an entanglement of mixed natural and synthetic fibers) Materials that are found in both the liquid and air filtration and cleaning industries may find use in the cleaning cloth. The selection of the cleaning cloth is important for the performance of the peroxide based cleaning composition. The selection of the substrate affects a number of additional performance variables in the cleaning cloth. For example, the type of cleaning cloth affects; the amount (weight) of cleaning composition loadable on the cleaning cloth, the percentage (%) of detergent that is expressed in the first and each of the subsequent cleaning tasks, and lastly, the durability of the cleaning cloth under mechanical abrasion throughout multiple cleaning tasks. Of course, type of cleaning cloth may also affect biodegradability, sustainability and consumer perceptions of "environmental friendliness."

Suitable cleaning cloth may be constructed from any number of various water-insoluble nonwoven materials, called "fabrics". Nonwoven fabrics, with their multitude of uses, are well known to those skilled in textiles. Nonwovens are described very thoroughly in "Nonwoven Fabrics: Raw Materials. Manufacture, Applications, Characteristics, Testing Processes", editors W. Albrecht, H. Fuchs and W. Kittelmann, Wiley-VCH Verlag GmbH & Co. KgaA Weinheim, 2003 Such material can be prepared by forming a web of continuous filament and/or staple fibers and optionally bonding these fibers at fiber-to-fiber contact points to provide fabrics with the desired properties. The term "bonded nonwoven fabric" is used to include nonwoven fabrics where a major portion of the fiber-to-fiber bonding is achieved by either thermal fusion of adjacent fibers, or adhesive bonding that is accomplished through incorporation of adhesives in the web to "glue" fibers together, or by other bonding such as obtained by the use of liquid or gaseous bonding agents (usually in conjunction with heating) to render the fibers cohesive. Chemical bonding may be accomplished through the use of adhesive or latex powders dispersed between the fibers in the web, which is then activated by heat, ultraviolet or infrared radiation, or other suitable activation method. Thermally and chemically bonded carded webs are described in U.S. Pat. No. 6,689,242 to Bodaghi, the subject matter of which is incorporated herein. Thermally and/or chemically bonded nonwovens may be used as the cleaning cloth within the present disclosure Powder bonding is a dry process that starts with the carding of staple fibers to form a fibrous web, which is then treated with powdered thermal plastic adhesive or latex materials and subjected to a series of ovens and calendar rolls to produce the nonwoven.

Nonwovens may also comprise fibers known as "bi-component fibers", for example "sheath/core bi-component fibers", which are fibers having an outer sheath area or layer with a lower melting point than the inner core area, allowing for efficient and controlled thermal bonding through melting of just the outer layer of each fiber. That is, the outer surface of a bi-component fiber can be made to have a lower melting point than the core of the fiber. For example, binder bi-component fibers where one component has adhesive properties under bonding conditions are widely employed to provide integrity to fibrous webs used as absorbents in personal care products or in filtration products. Additionally, multi-component fibers are similarly known and commercially incorporated into nonwovens. Examples of Such multi-component fibers are described in U.S. Pat. No. 5,382,400 (Pike et al.) and U.S. Pat. No. 5,866,488 (Terada et al.) and incorporated herein in their entireties.

During the bonding of the fibers, the web may be simultaneously subjected to mechanical compression to obtain the desired bonding, weights and thicknesses in a process known as "thermal compression bonding." Thermal compression bonding may be accomplished by using a hot embossing roll and a heat flat calendar roll, and incorporating a method in which a heat treating machine such as a hot blast-circulating type, a hot through-air type, an infrared heater type or a vertical hot blast-blowing type is used to carry out thermal compression bonding. Mechanical compression may be used to set the loft or thickness of fabrics with similar basis weights Normally, increasing the basis weight, or the mass per square area increases thickness, and increasing bonding and compression, decreases loft. Nonwovens may be constructed by laminating together two or more carded webs of fibers, the net result being a thicker nonwoven wherein it is difficult to discern layers.

Nonwoven webs may be formed from a number of processes, for example, melt-blown, spun-bonded or spun-laid, toe-opened, wet-laid, air-laid, carded, and high pressure hydro-entangled. The basis weight of nonwoven webs is usually expressed in ounces of material per square yard (osy) or grams per square meter (gsm) and the fiber diameters are usually expressed in microns, or in the case of staple fibers, "denier." Denier is defined as grams per 9000 meters of fiber length. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. The "mean fiber denier" is the sum of tile deniers for each fiber, divided by the number of fibers. A distribution of deniers or an "average fiber denier" refers to a distribution of fiber diameters around a specific value. As used herein, the term "bulk density" refers to the weight of a material per unit of volume and usually is expressed in units of mass per unit of bulk volume (e.g., grams per cubic centimeter). Nonwovens may be produced by fibers having a single average value of diameters or denier, or two or more average value diameter fibers may be used together. For example, two or more distributions of fiber deniers may be combined into separate fiber webs (2½ denier and 4 denier fibers carded together for example) Then separate fiber webs may be laminated together. For example, a single nonwoven may comprise 2½, 4, 6, and 15 denier fibers, meaning it was constructed with four separate denier fibers (four separate average diameters of fibers.

"Spun-bonded fibers" refers to fibers formed by extrusion of molten thermoplastic material as filaments, described for example in U.S. Pat. No. 4,340,563 to Appel; U.S. Pat. No. 3,692,618 to Dorschner; U.S. Pat. No. 3,802,817 to Matsuki; U.S. Pat. Nos. 3,338,992 and 3,341,394 to Kinney, U.S. Pat. No. 3,502,763 to Hartman, U.S. Pat. No. 3,542,615 to Dobo; and, U.S. Pat. No. 5,382,400 to Pike, the entire contents of each incorporated herein by reference. Spun-bond fibers are generally not tacky when they are deposited onto a collecting surface. Spun-bond fibers are generally continuous and have average diameter from about 7 microns to about 60 microns, and most often between about 15 and 25 microns.

Melt-blown" refers to fibers formed by extruding molten thermoplastic material through a plurality of fine, normally circular, die capillaries as molten threads or filaments into converging high velocity, usually hot, gas/air streams that attenuate the filaments of molten thermoplastic material to reduce their diameter, which may end up at micro-fiber diameter. Thereafter, the melt-blown fibers are carried by tile high velocity gas stream and are deposited on a collecting surface to form a web of randomly dispersed fibers. Such a process is disclosed, for example, in U.S. Pat. No. 3,849,241 (Butin et al.). Melt-blown fibers are micro-fibers that may be continuous or discontinuous, and are generally smaller than 10 microns in average diameter, and are generally tacky when deposited onto a collecting surface.

Air-laid" is a well-known process by which a fibrous nonwoven layer can be formed. In the air-laid process, bundles of small fibers having typical lengths of from about 3 to about 52 millimeters are separated and entrained in an air supply and deposited onto a forming screen, usually with the assistance of a vacuum. The randomly deposited fibers then are bonded to one another using, for example, hot air to activate a binder component or latex adhesive. The air-laying process is taught in, for example, U.S. Pat. No. 4,640,810 to Laursen and U.S. Pat. No. 5,885,516 to Christensen.

The preferred fibers incorporated in the cleaning cloth may be single-, bi- (e.g., sheath/core), or multi-component fibers, made from; poly-olefins such as polypropylene, polyethylene; various polyesters such as poly(ethylene terephthalate)-PET, poly(butylene terephthalatel-PBT or poly(trimethylene terephthalatel-PTT, polycarbonates, or polybutyrates and tile like; viscose rayon; various polyamides such as nylons; polyacrylates; and, modacrylics, and mixtures of these types of polymers.

The preferred deniers for the fibers that may be used in the cleaning cloth are about 2-16 denier. More preferred is to use poly-olefin fibers or polyester fibers. Preferably the poly-olefin is polyethylene, polypropylene or polybutylene, and the polyester is poly-(ethylene terephthalate) or poly-(butylene terephthalate) or poly-(trimethylene terephthalate), (i.e., PET, PBT or PTT).

Peroxide based cleaning compositions are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

All structural, chemical, and functional equivalents to the elements of the above-described various embodiments that are known to those of ordinary skill in the art are expressly incorporated herein by reference and are intended to be encompassed by the present claims. Moreover, it is not necessary for a composition or method to address each and every problem sought to be solved by the present disclosure, for it to be encompassed by the present claims. Furthermore, no element, component, or method step in the present disclosure is intended to be dedicated to the public regard-less of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a chemical, chemical composition, process, method, article, or apparatus that comprises a list of elements does not include only those elements but may include other elements not expressly listed or inherent to such chemical, chemical composition, process, method, article, or apparatus.

The invention claimed is:

1. A composition consisting of: hydrogen peroxide; a builder; an anionic surfactant; and a peroxide stabilizer; with remainder water and optional essential oil fragrance; wherein the composition is in the physical form of a paste.

2. The composition of claim 1, wherein the builder is selected from the group consisting of NaOH, KOH, $NH_3$, sodium acetate, sodium succinate, disodium succinate, monosodium citrate, disodium citrate, trisodium citrate, $NaH_2PO_4$, $Na_2HPO_4$, $Na_3PO_4$, $KH_2PO_4$, $K_2HPO_4$, $K_3PO_4$, $NaHSO_4$, $Na_2SO_4$, $KHSO_4$, $K_2SO_4$, $NaHCO_3$, $Na_2CO_3$, $KHCO_3$, $K_2CO_3$, $NaH_3P_2O_7$, $Na_2H_2P_2O_7$, $Na_3HP_2O_7$, $Na_4P_2O_7$, $KH_3P_2O_7$, $K_2H_2P_2O_7$, $K_3HP_2O_7$, $K_4P_2O_7$, and mixtures thereof.

3. The composition of claim 1, wherein the anionic surfactant is an animal or vegetable fatty acid soap of general formula R—$CO_2$M, wherein R represents a linear or branched alkyl or alkenyl group having between about 8 and 24 carbons and M represents sodium or potassium.

4. The composition of claim 1, wherein the peroxide stabilizer is a triol.

5. The composition of claim 1, wherein the peroxide stabilizer is glycerin.

6. A cleaning composition consisting of:

0.4 wt. % active hydrogen peroxide;

80.3 wt. % sodium bicarbonate;

3.3 wt. % of potassium $C_{14}$-$C_{18}$ fatty acid soap;

3.8 wt. % of glycerin; and remainder water, with optional essential oil fragrance; wherein the composition is in the physical form of a paste.

7. A cleaning kit comprising:

a container with an opening configured with screw threads dimensioned to accept a screw cap lid;

a cleaning composition according to claim 6 packaged in said container;

a cleaning cloth disposed over the opening of the container; and the screw cap lid secured on the opening of the container and over the cleaning cloth such that the cleaning cloth is secured over the opening with the cleaning cloth running through the screw threads, wherein the container is capable of venting $O_2$ from the cleaning composition through the screw threads while the screw cap lid is secured on the opening of the container and over the cleaning cloth.

8. The cleaning kit of claim 7, wherein the cleaning cloth comprises a nonwoven.

9. A method of cleaning using the cleaning kit of claim 7, wherein the cleaning kit is opened, cleaning composition is scooped from the container and applied to a surface to be cleaned, and wherein the cleaning cloth is used to spread the cleaning composition on the surface and to rinse the surface with rinse water.

* * * * *